US006206765B1

(12) United States Patent
Sanders et al.

(10) Patent No.: US 6,206,765 B1
(45) Date of Patent: Mar. 27, 2001

(54) NON-ROTATIONAL DRESSER FOR GRINDING STONES

(75) Inventors: William A. Sanders; Michael E. Sanchez, both of Santa Rosa; Jolanda L. Like, Rohnert Park, all of CA (US)

(73) Assignee: Komag, Incorporated, San Jose, CA (US)

( * ) Notice: Subject to any disclaimer, the term of this patent is extended or adjusted under 35 U.S.C. 154(b) by 0 days.

(21) Appl. No.: 09/375,166

(22) Filed: Aug. 16, 1999

(51) Int. Cl.[7] ..... B29B 1/00

(52) U.S. Cl. ..... 451/56; 451/72; 451/403; 451/262; 451/264; 451/255; 451/259

(58) Field of Search ..... 451/56, 72, 403, 451/262, 264, 255, 256, 257, 258, 259

(56) References Cited

U.S. PATENT DOCUMENTS 4,208,842 * 6/1980 Katzke et al. ..... 451/262
4,635,401 * 1/1987 Nakaji ..... 451/72
5,010,692 * 4/1991 Ishida et al. ..... 451/41
5,538,460 7/1996 Onodera .
5,967,882 * 10/1999 Duescher ..... 451/57
6,036,585 * 3/2000 Nishi et al. ..... 451/259

* cited by examiner

*Primary Examiner*—David A. Scherbel
*Assistant Examiner*—Shantese McDonald
(74) *Attorney, Agent, or Firm*—Skjerven Morrill MacPherson LLP

(57) ABSTRACT

A dresser for a grinder having at least one rotatable platen and at least one grinding stone includes a frame and at least one abrasive block for contacting the grinding stone. The grinding stone is mounted to the platen which rotates about a vertical axis. The abrasive block extends across the grinding stone. The frame of the dresser is mounted proximate the platen and remains stationary while the grinding stone rotates. The abrasive block contacts the rotating grinding stone, thereby dressing the grinding stone.

25 Claims, 12 Drawing Sheets

NON-ROTATIONAL DRESSER FOR GRINDING STONES

FIELD OF THE INVENTION

The present invention relates to an apparatus for grinding rigid, thin-film substrates used in electronic equipment. More particularly, the present invention relates to a dresser for precision dressing of the grinding stones of the apparatus.

BACKGROUND

Rigid, thin-film disks are the primary storage medium for digital data used in computer disk drives. A rigid, thin-film disk recording medium includes a rigid substrate that is coated with a storage material, such as a magnetic or optical material. The storage capacity of these recording media can range from a few hundred kilobytes to several gigabytes. As technology advances, so does the need for rigid, thin-film disk recording media with increased storage capacity. One way of increasing the storage capacity of a rigid, thin-film disk is to maximize the surface area of the disk by extending recordable tracks to the outer edge of the disk. Tracks near the outer edge of a disk have a larger circumference and are, therefore, capable of storing more data than those located closer to the center of the disk.

In the manufacture of rigid, thin-film disk recording media, prior to their coating with a storage material, a conventional grinding apparatus grinds the surfaces of the rigid substrates to a desired finish. One such conventional grinding apparatus is a planetary grinder having two rotating platens: an upper platen; and a lower platen. Each platen includes a grinding wheel made up of several grinding stones for grinding a surface of the rigid substrates. A sun gear and a ring gear are mounted in close proximity to the lower platen. The grinder further includes a plurality of substrate carriers disposed between the grinding wheels of the platens. The substrate carriers, each of which is capable of carrying several substrates, are coupled to the sun and ring gears of the grinder. In operation, the substrate carriers are loaded with rigid substrates, and the upper platen is lowered onto the substrate carriers, such that the grinding stones of the upper and lower platens contact the respective upper and lower surfaces of the substrates. As the sun gear and/or ring gear rotates, the substrate carriers simultaneously revolve around the sun gear and rotate about their own axis between the two grinding wheels, thereby grinding the surfaces of the substrates.

Over time, the grinding stones become worn and require dressing to restore them to their original quality. Grinding stones are typically dressed using a conventional ring dresser. The ring dresser is an annular disk, similar in size to a substrate carrier, with teeth along its outer circumference and diamond pellets on both planar surfaces. During the dressing process, at least three substrate carriers are replaced with the ring dressers, and the upper platen is lowered until both grinding wheels are in contact with the ring dressers. As the sun gear is rotated, the ring dressers revolve around the sun gear and rotate about their axes to dress the grinding stones.

One problem with conventional ring dressers is that they fail to dress the grinding stones properly, resulting in rigid substrates with a high outer diameter (OD) radial curvature. FIG. 1 illustrates the profile of a lower platen grinding stone immediately after being dressed with a conventional ring dresser. Portions of the grinding stone along the edges proximate the sun and ring gears receive less exposure to the ring dressers than areas in between. Because the ring dressers have the same dimensions as the substrate carriers, only the outer portion of the ring dressers dress the innermost and outermost portions of the grinding stone, and less material is removed from these areas of the grinding stone. As a result, the inner and outer edges of the grinding stone are highly aggressive and will remove more material from the rigid substrates than other portions of the grinding stone. These grinding stones will produce rigid substrates with a high OD radial curvature, because only the outermost edge of the substrates contacts the inner and outer edges of the grinding stones as the substrate carriers rotate and revolve around the sun gear. A high OD curvature, also referred to as "radial curvature," "roll off" or "dub off," significantly limits the storage capacity of a rigid, thin-film disk recording medium, because it reduces the number of recordable tracks along the outer edge of the disk.

Two known methods of addressing the OD curvature problem associated with ring dressers include the use of low grinding pressures and the use of toleranced carriers. The first method, operating at low grinding pressures, is an inefficient use of the grinder. Low grinding pressures extend run times, thereby decreasing the machine's throughput. In addition, low grinding pressures can result in premature grinding stone loading and increased costs.

The second method employs toleranced carriers. Toleranced carriers are substrate carriers that have a thickness very close to the desired thickness of the rigid substrate. The grinding apparatus grinds the substrates down to the toleranced carriers. Toleranced carriers, however are difficult to manufacture. In addition, because the grinding stones apply pressure loads to the toleranced carriers rather than to the rigid substrates, toleranced carriers extend run times and decrease throughput. Moreover, toleranced carriers are subject to wear and must be routinely replaced.

Thus, there is a need for a dresser which provides for preferential shaping of the grinding stones. In particular, the dresser should eliminate regions of high aggressiveness at the inner and outer edges of the grinding stones.

SUMMARY

In accordance with an embodiment of the present invention, a dresser for a grinder includes a frame and at least one abrasive block. The grinder has at least one platen that is rotatable about a vertical axis and at least one grinding stone mounted to the platen. The frame of the dresser is disposed proximate the platen. The abrasive block is coupled to the frame and contacts the grinding stone. The abrasive block extends across the grinding stone of the grinder to dress the grinding stone. Because the frame does not rotate with the platen, the abrasive block remains stationary when the platen rotates. The abrasive block of the dresser dresses the grinding stone, when the stone rotates while in contact with the surface of the abrasive block.

In accordance with another embodiment of the invention, a grinding apparatus includes at least one platen, a dresser frame and at least one abrasive block. The platen is rotatable about a vertical axis and includes at least one grinding stone. The dresser frame is removably mounted proximate the platen, and the abrasive block is coupled to the frame for contacting the grinding stone, as described above. The dresser frame does not rotate with respect to the rotatable platen and grinding stone.

In accordance with still another embodiment of the invention, a method of dressing grinding stones on a grinder includes mounting a dresser proximate at least one rotatable platen of the grinder. The dresser has at least one dressing surface for contacting at least one grinding stone mounted on the platen. The dressing surface of the dresser extends across the grinding stone. The method further includes rotating the platen while the dresser remains stationary so as to dress the grinding stone.

The present invention is advantageous because it eliminates the OD curvature problem. Since the abrasive blocks of the dresser extend across the entire length of the grinding stones, the dresser ensures that the amount of material removed along the inner and outer edges of the grinding stones is at least the same as, if not more than, the amount removed at other portions of the grinding stones. The present invention allows for preferential shaping of the grinding stones.

BRIEF DESCRIPTION OF THE DRAWINGS

The present invention may be better understood and its numerous features and advantages made apparent to those skilled in the art by referencing the accompanying drawings.

DETAILED DESCRIPTION

Figure 1:
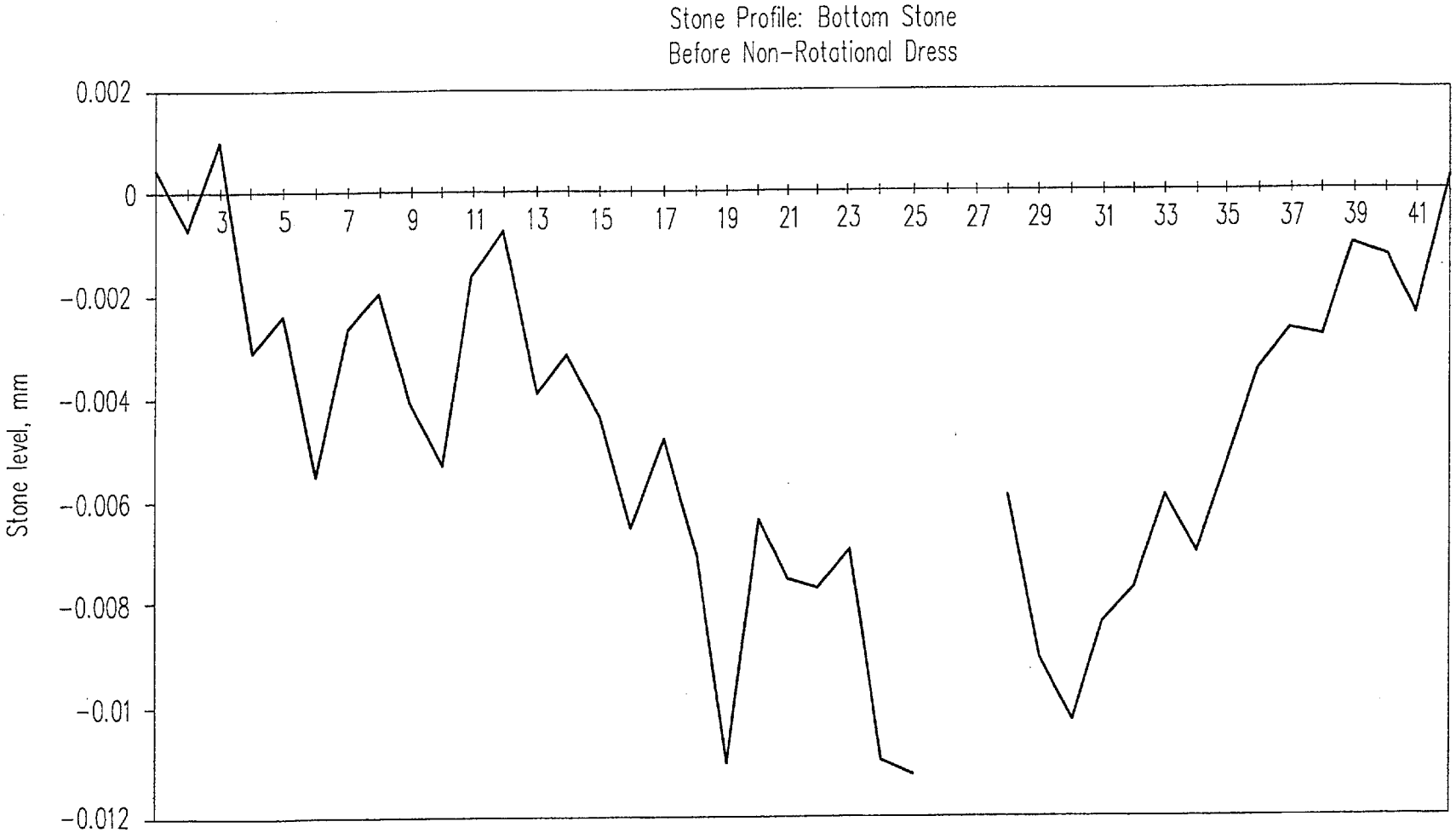
FIG. 1 (Prior Art)
FIG. 1 is a chart illustrating the profile of a grinding stone immediately following a conventional ring dressing process.
Figure 2:
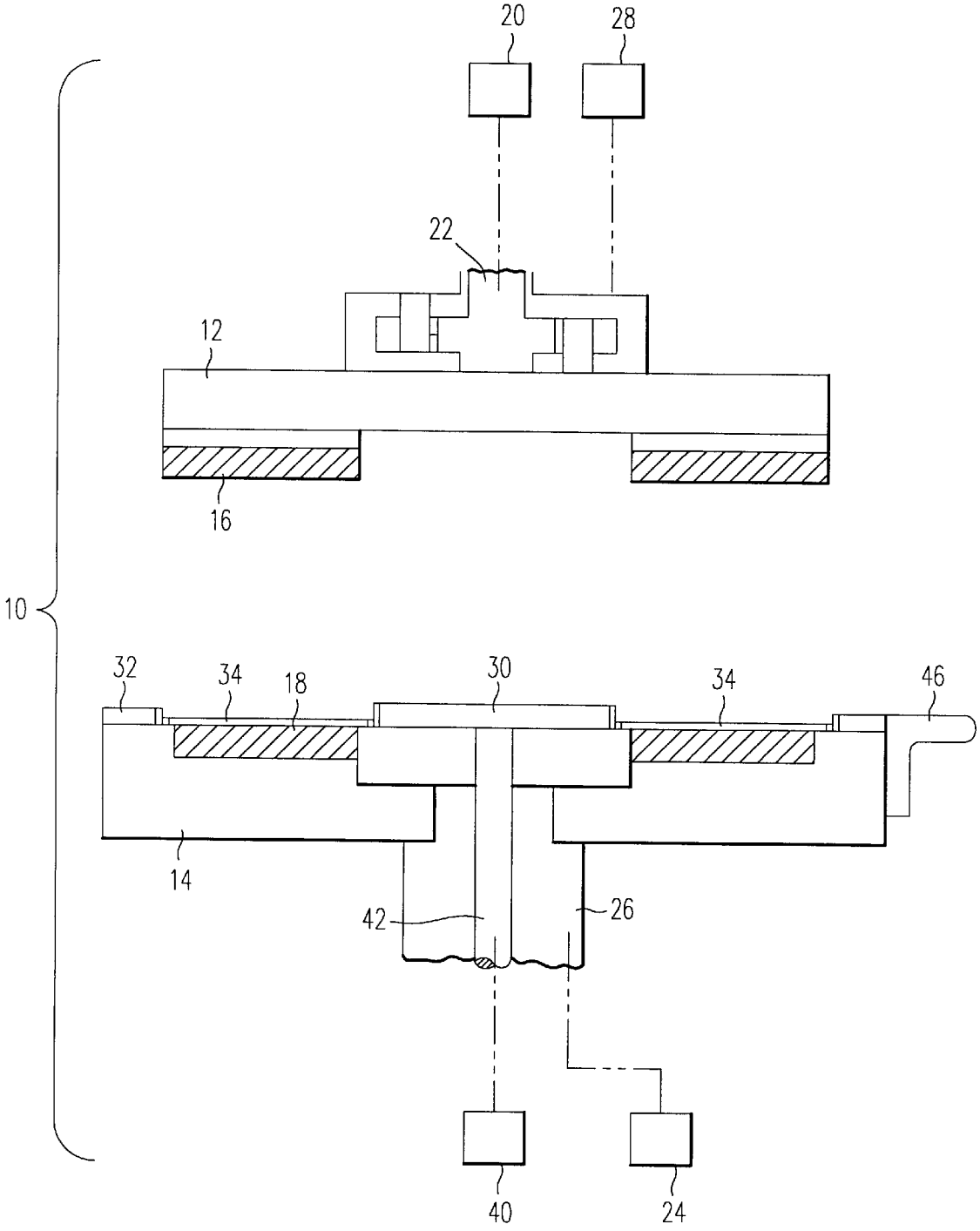
FIG. 2 is a diagrammatical side elevational view of a grinding apparatus for grinding rigid, thin-film substrates, including substrate carriers and a mounting plate for a non-rotational dresser unit.

FIG. 2 is a grinding apparatus 10 in accordance with the present invention. Grinding apparatus 10 includes an upper platen 12 and a lower platen 14, each having a grinding wheel 16 and 18 respectively mounted thereto. Upper and lower platens 12 and 14 are rotatable, rigid circular plates of stainless steel. Upper platen 12 is rotatably supported by a ball bearing (not shown). A motor 20 is coupled to upper platen 12 via a drive shaft 22 and operates to rotate upper platen 12. Similarly, a motor 24 is coupled to lower platen 14 via a drive shaft 26 and operates to rotate lower platen 14. In addition, a motor or pneumatically driven arrangement, denoted generally by reference numeral 28, operates to raise and lower upper platen 12 with respect to lower platen 14.

Grinding wheels 16 and 18 have an annular configuration. Each grinding wheel 16, 18 includes a plurality of grinding stones 17 (FIG. 3) made of a material suitable for grinding aluminum substrates. One such material is a polyvinyl alcohol (PVA) that has been impregnated with silicon carbide abrasives.

Figure 3:
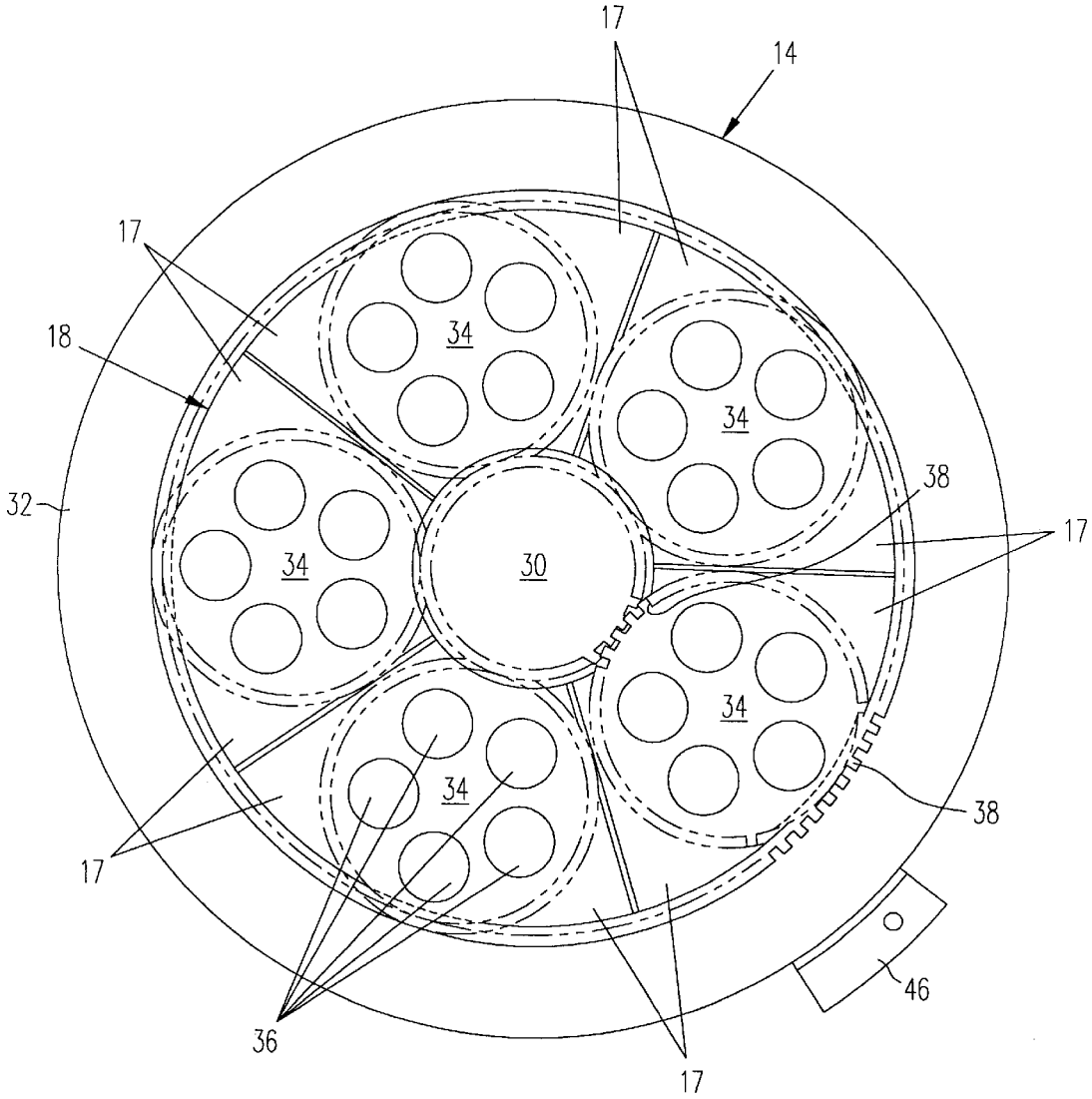
FIG. 3 is an enlarged plan view of the lower platen of the grinding apparatus shown in FIG. 2.

The grinding apparatus 10 further includes a sun gear 30, a ring gear 32 and a plurality of substrate carriers 34. Grinding apparatus 10 is shown having five substrate carriers 34, however, many different configurations of substrate carriers may be provided. Substrate carriers 34, which are best illustrated in FIG. 3, have a plurality of openings 36 formed therein for holding the rigid substrates (not shown) to be ground. Along their outer edge, substrate carriers 34 have gear teeth 38 which mesh with the teeth of sun and ring gears 30 and 32, respectively. A motor 40, coupled to sun gear 30 via a drive shaft 42, operates to rotate sun gear 30. As sun gear 30 rotates, substrate carriers simultaneously rotate about their own axis and revolve around sun gear 30.

In operation, rigid substrates of aluminum are loaded onto openings 36 of substrate carriers 34. The bottom surface of the rigid substrates contacts grinding stones 17 of lower grinding wheel 18. Motor 24 lowers upper platen 12 until grinding stones 17 of upper grinding wheel 16 contact the top surface of the rigid substrates. Motors 20, 24 and 40 then operate to rotate respective upper platen 12, lower platen 14 and sun gear 30 in a suitable manner to grind both surfaces of the rigid substrates.

Figure 4:
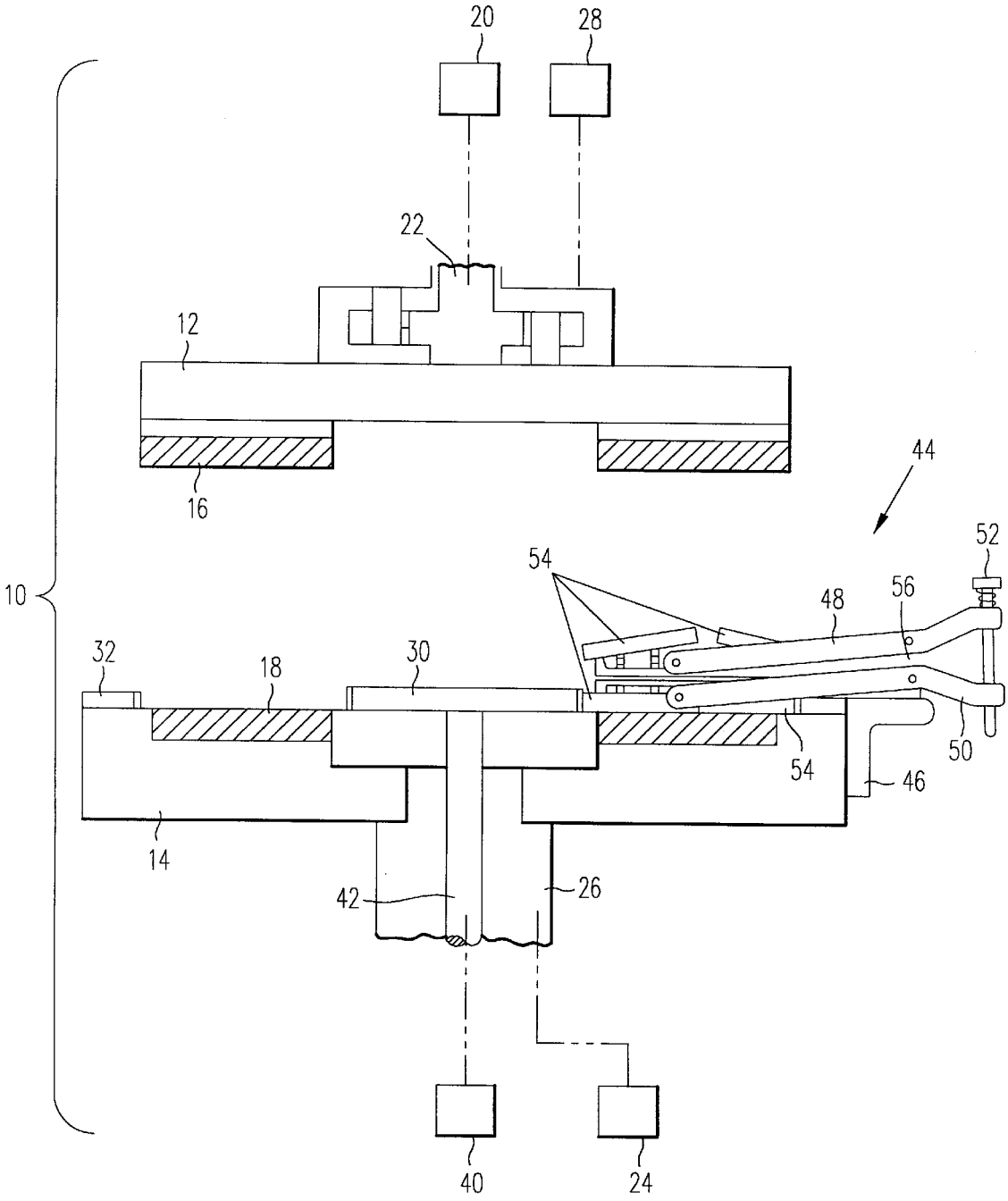
FIG. 4 is a diagrammatical side elevational view of the grinding apparatus of FIG. 2, with the substrate carriers removed and a non-rotational dresser, in accordance with the present invention, mounted to the mounting plate.

The process of grinding the rigid substrates also wears down grinding stones 17 of grinding wheels 16 and 18. Accordingly, grinding stones 17 must be dressed periodically to recapture their desired surface characteristics. FIG. 4 illustrates a non-rotational dresser 44 for a dressing process installed on grinding apparatus 10. Substrate carriers 34 have been removed from lower platen 14, and dresser 44 is mounted to a mounting plate 46 proximate lower platen 14. Dresser 44 is removably mounted to mounting plate 46 by a conventional fastener, such as a screw, bolt or other mechanical fastener (not shown).

Figure 5:
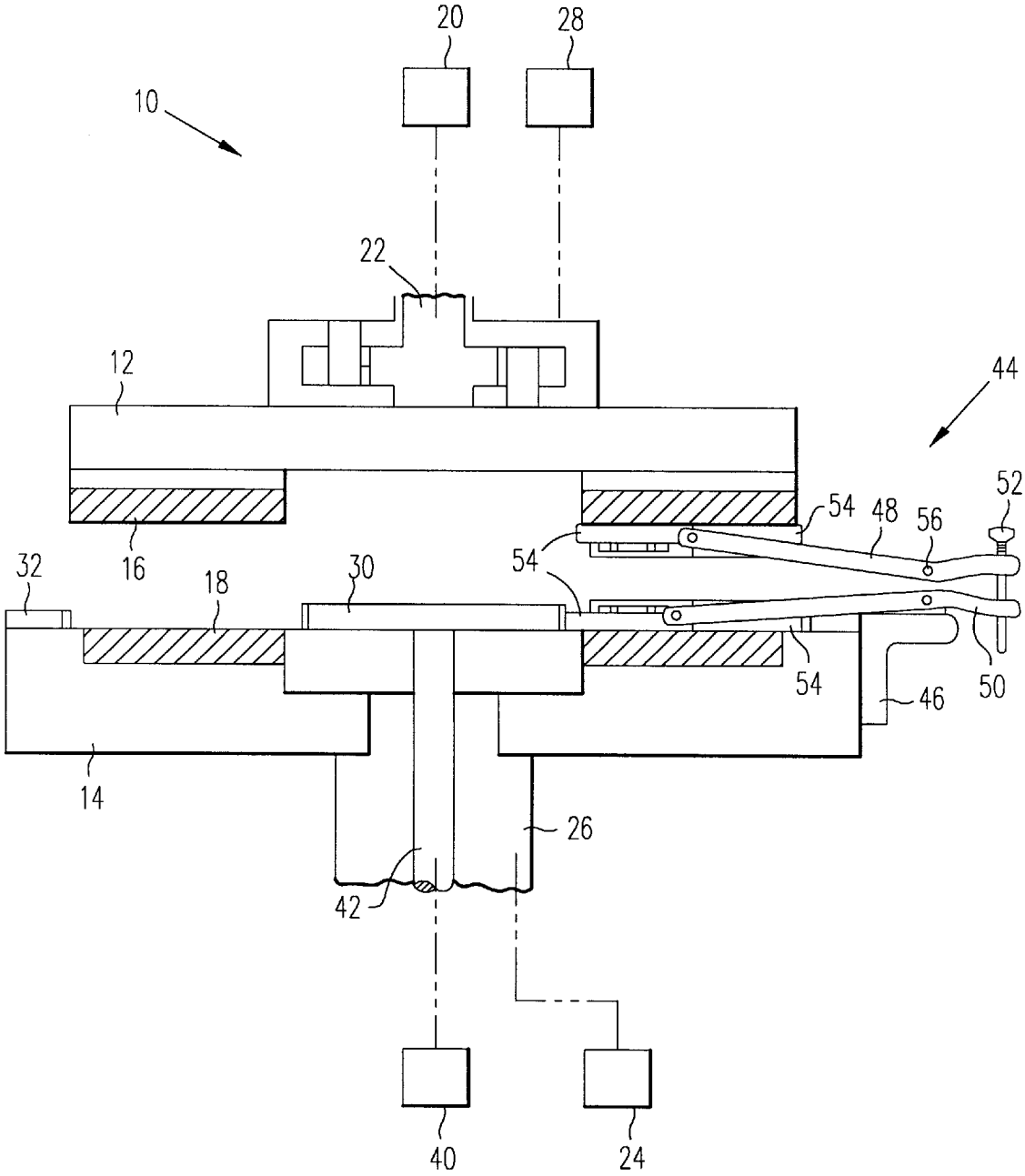
FIG. 5 is a diagrammatical side elevational view of the grinding apparatus of FIG. 4 during a dressing process.

Dresser 44 includes an upper support arm 48, a lower support arm 50 and a long screw 52. Attached to upper and lower support arms 48 and 50, respectively, are abrasive blocks 54 which dress grinding stones 17 of grinding wheels 16 and 18. Support arms 48 and 50, respectively, are pivotally coupled together at pivot point 56. Screw 52 connects distal ends 58 of support arms 48 and 50. When screw 52 is tightened, distal ends 58 of support arms 48 and 50 move closer together, and proximal ends 60 spread apart from each other, to raise abrasive blocks 54 attached to upper support arm 48 (FIG. 5).

FIGS. 6–10 provide more detailed illustrations of dresser 44. For purposes of simplicity, only the upper half of dresser 44 will be described. The lower half of dresser includes the same elements in a mirror configuration. At proximal end 60, upper support arm 48 is coupled to a frame plate 62 via a mount 64. Mount 64 is located midway between the ends of frame plate 62. Conventional fasteners 66, such as screws or bolts, fixedly secure mount 64 to frame plate 62. Alternatively, mount 64 may also be welded to frame 62. A bearing 68 provides a pivotal connection between mount 64 and distal end 58 of upper support frame 48.

Abrasive blocks 54 are mounted to frame plate 62. Abrasive blocks 54 have a dressing surface 70 for dressing grinding stones 17 of grinding wheels 16 and 18. For example, in FIG. 6 surface 70 is covered with diamond pellets 72. In the preferred embodiment of the invention, there are two abrasive blocks 54 for each frame plate 62. One skilled in the art, however, will appreciate that the frame plate can have a single abrasive block or more than two abrasive blocks.

Figure 9:
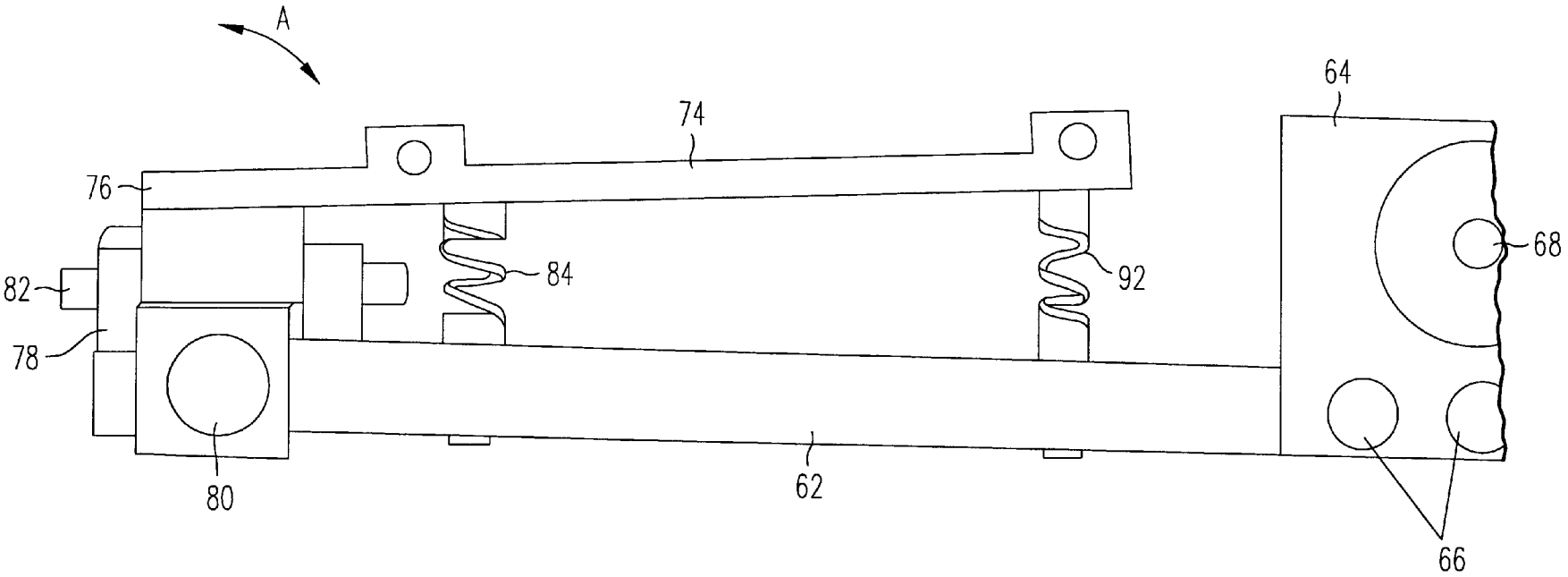
FIG. 9 is an enlarged, partial side elevational view of the upper frame plate of FIG. 8, with the abrasive blocks removed.
Figure 10:
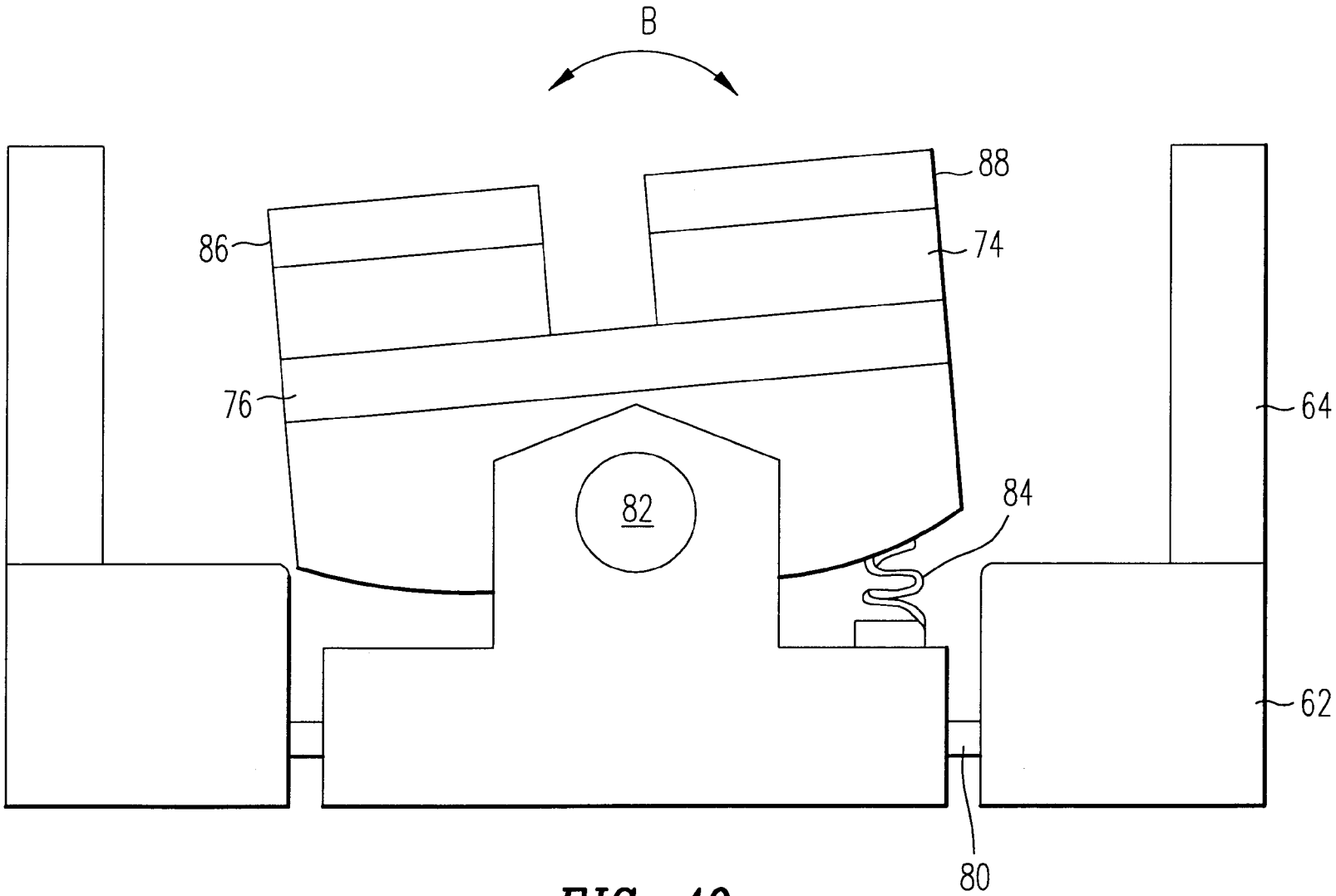
FIG. 10 is an end view of the upper frame plate of FIG. 9.

Each abrasive block 54 is affixed to a dresser backing plate 74 by conventional fasteners (not shown), such as screws or bolts. Alternatively, abrasive blocks 54 can be welded to backing plates 74 or secured thereto with an adhesive. Each backing plate 74 is pivotally coupled at an outer end 76 to one end of frame plate 62 by a bracket 78. Bracket 78 is generally a U-shaped member. A bearing 80 pivotally connects the bottom portion of bracket 78 to the end of frame plate 62, enabling bracket 78 to rotate about the end of frame 62. Another bearing 82 pivotally connects backing plate 74 to bracket 78. Thus, as best illustrated in FIGS. 9 and 10, bracket 78 provides backing plate 74 and abrasive block 54 with two degrees of motion: pitch and roll. Bearing 80 provides pitch capabilities by allowing backing plate 74 and abrasive block 54 to rotate about the end of frame plate 62, as indicated by arrow A in FIG. 9. Bearing 82 provides roll capabilities by allowing backing plate 74 and abrasive block 54 to rotate about their longitudinal axis, as indicated by arrow B in FIG. 10. It should be noted that bearing 82 restricts angular movement about the vertical axis, thereby preventing yaw. Thus, abrasive blocks 54 will not be displaced in the lateral direction by the rotation of grinding stones 17.

Support arms 48 and 50, frame plates 62, brackets 78 and backing plates 74 can be made of any durable material such as aluminum or stainless steel by conventional machining techniques.

Adjacent bracket 78, a spring 84 couples backing plate 74 to frame plate 62. Spring 84 is preferably a compression spring. As illustrated in FIG. 10, spring 84 is offset to one side of backing plate 74 and frame plate 62. Spring 84, in conjunction with bearings 80 and 82, biases that side of backing plate 74 and abrasive block 54 upward. Spring 84 is offset to the side of abrasive block 54 which contacts rotating grinding stones 17 last. For example, in FIG. 10 grinding stones 17 rotate across abrasive block 54 from left to right and, therefore, will pass across the left side 86 of abrasive block 54 and backing plate 74 first. Accordingly, spring 84 is located proximate the right side 88 of backing plate 74 and biases right side 88 upward. As grinding stones 17 pass across abrasive block 54 and backing plate 74, abrasive block 54 and backing plate 74 will rotate about bearing 82 and true themselves. This arrangement is advantageous, because it prevents abrasive blocks 54 from catching on the edges of rotating grinding stones 17 and enables abrasive blocks 54 to adjust automatically to the surface configuration of the particular grinding stone.

Proximate an inner end 90, backing plate 74 is coupled to frame plate 62 by a spring 92. Spring 92 is preferably a tension spring. Depending on the desired shape of grinding stones 17, however, spring 92 can also be a compression spring. Spring 92 ensures that the proper vertical load from screw 52 is transmitted by inner end 90 of backing plate 74, through abrasive block 54 and to grinding stones 17.

Figure 6:
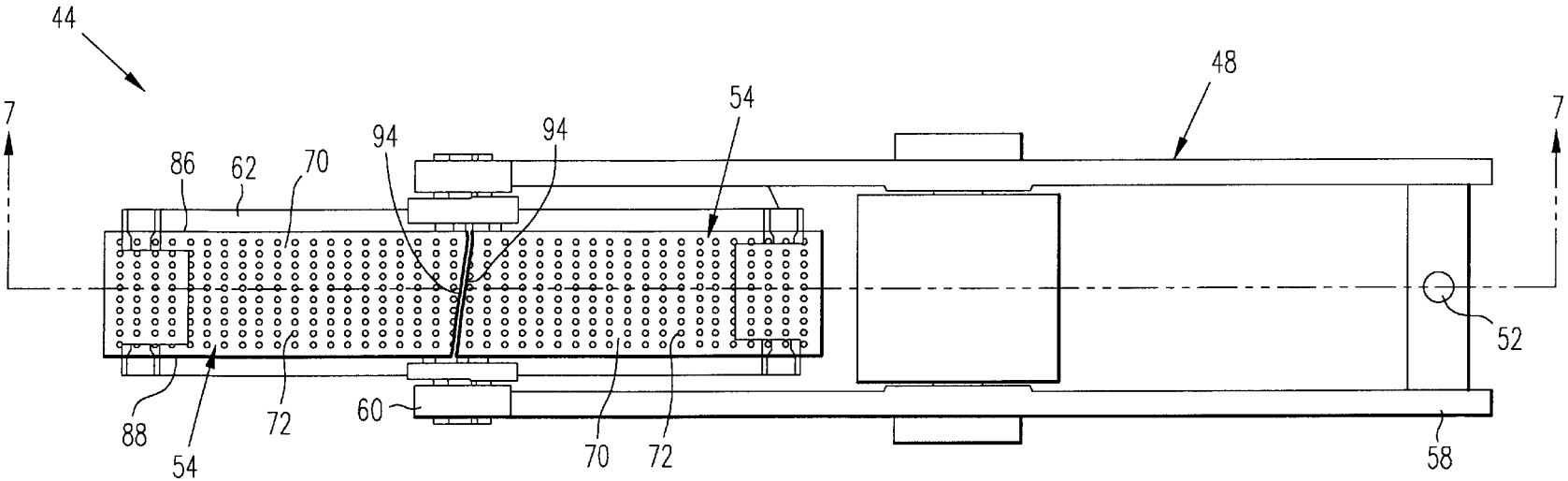
FIG. 6 is a top plan view of the dresser shown in FIGS. 4 and 5.
Figure 7:
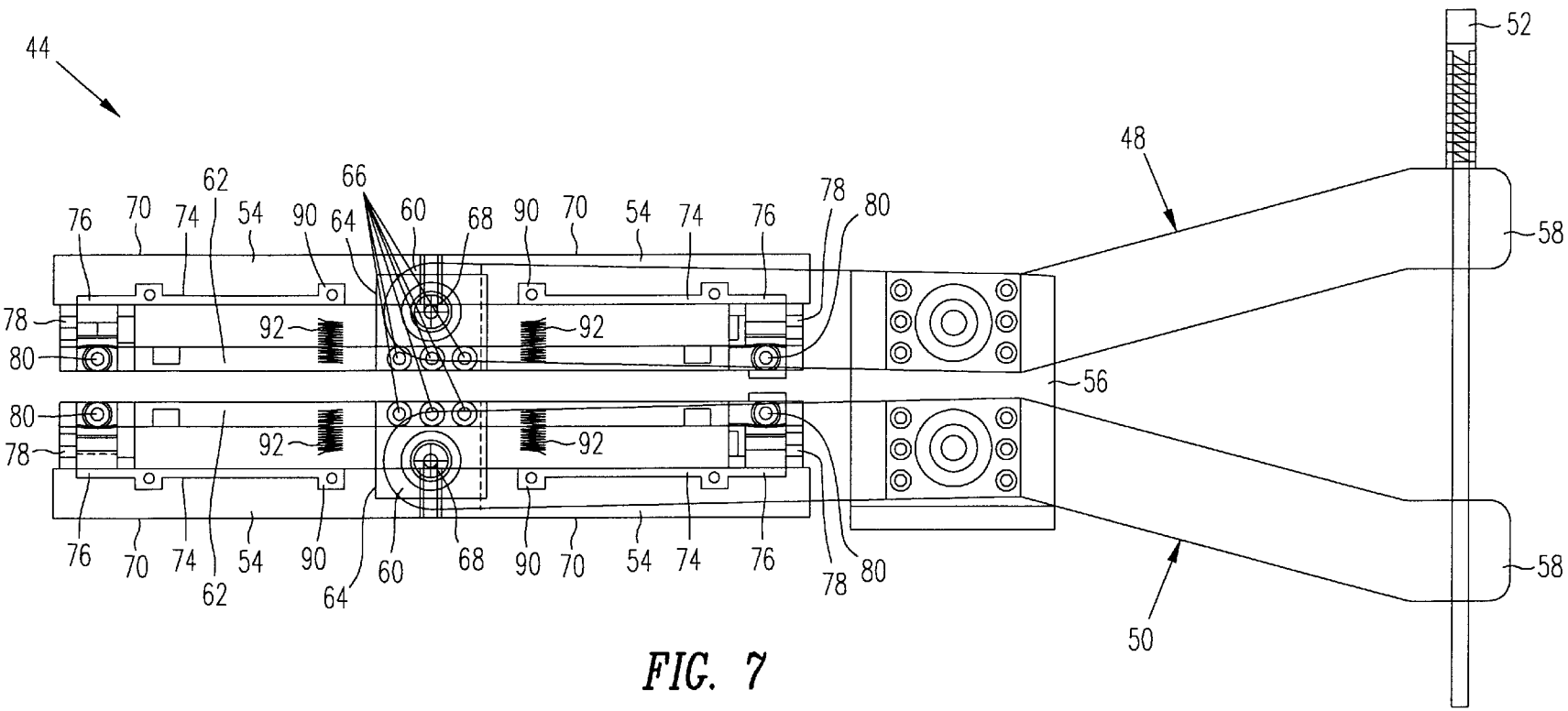
FIG. 7 is a cross-sectional view taken generally along the line 7—7 of FIG. 6.
Figure 8:
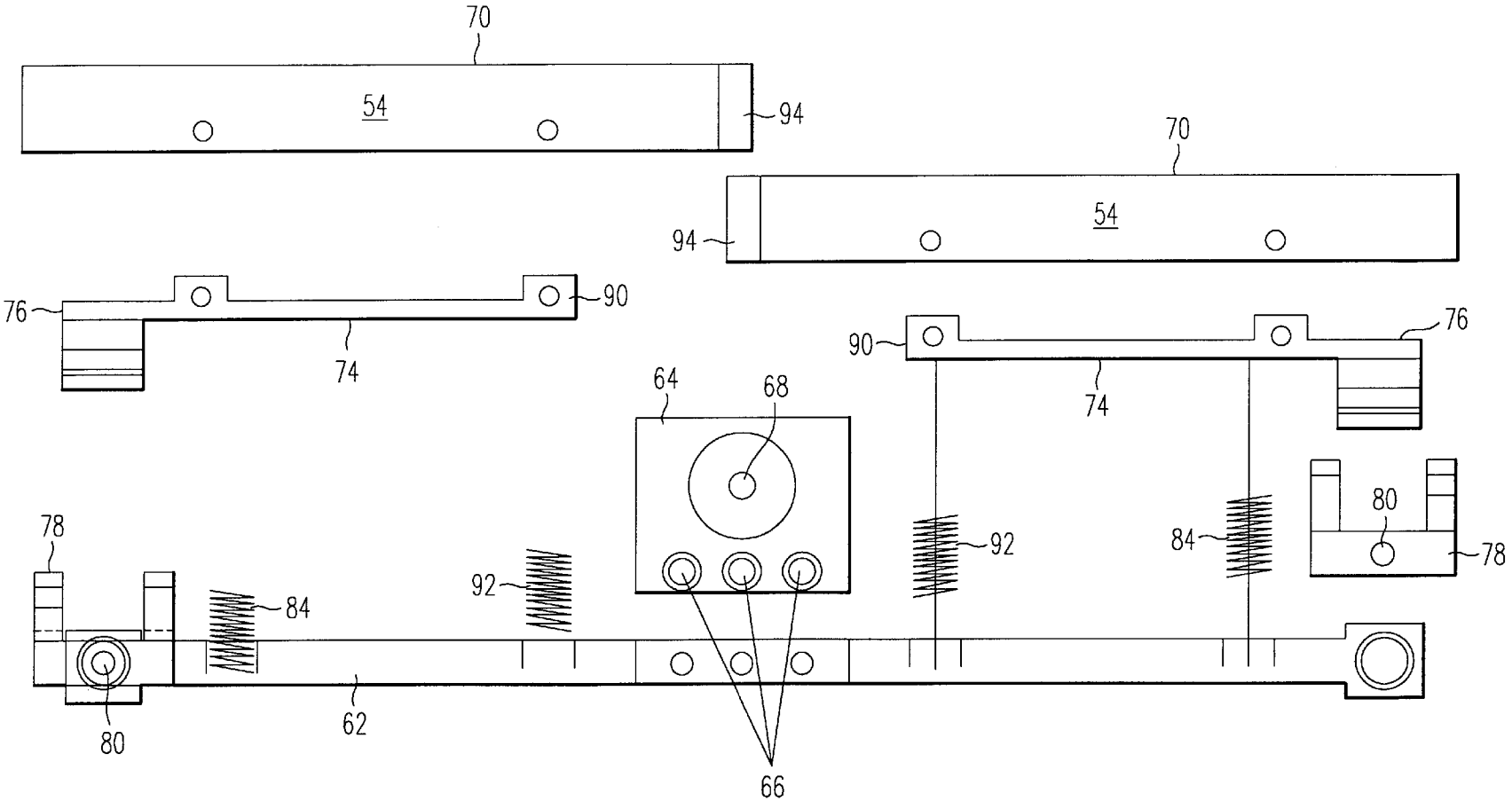
FIG. 8 is a partially exploded view of the upper frame plate of the dresser of FIG. 6.

As mentioned earlier, the preferred embodiment of the invention has two abrasive blocks 54 mounted to frame plate 62. Abrasive blocks 54 are not quite rectangular in shape. Instead, as best illustrated in FIGS. 6 and 8, inner edges 94 of abrasive blocks 54 do not extend perpendicular to left and right sides 86 and 88, respectively, of abrasive blocks 54. Inner edges 94 of the two abrasive blocks 54 mounted to frame plate 62 complement each other. The overlap of inner edges 94 of abrasive blocks 54 at the center of dresser 44 ensures that there is a smooth transition between abrasive blocks 54, such that they appear as a single block spanning across the entire length of grinding stones 17.

A dressing process using dresser 44 will be described below. Prior to dressing grinding stones 17, grinding apparatus 10 has been used to grind multiple batches of rigid substrates. As a result of operation of the grinding apparatus, the grinding stones become worn, particularly in the region between the innermost and outermost portions of the stone. Without dressing, innermost and outermost portions are highly aggressive, and substrates ground on this apparatus will have an undesirable high OD curvature. Thus, grinding stones 17 must be periodically dressed to return stones 17 to their optimal grinding profile.

Substrate carriers 34 are first removed from lower platen 14. Dresser 44 is mounted to mounting plate 46 with proximal ends 60 of support arms 48 and 50 together, as illustrated in FIG. 4. Abrasive blocks 54 coupled to lower support arm 50 rest on grinding stones 17 of lower platen 18. The weight of dresser 44 compresses springs 84 in the lower half of dresser 44, so that lower abrasive blocks 54 are level with grinding stones 17 of lower platen 14. Because upper platen 12 is not yet in contact with upper abrasive blocks 54, springs 84 in the upper half of dresser 44 bias upper abrasive blocks 54 upward.

Next, motor 28 operates to lower upper platen 12 toward dresser 44. Proximal ends 60 of support arms 48 and 50 separate until upper abrasive blocks 54 contact grinding stones 17 of upper platen 12. Screw 52 is adjusted until support arms 48 and 50 apply a desired load to grinding stones 17. By way of example, screw 52 is tightened until a load of approximately 18 lbs. is applied to grinding stones 17. Other loads may be applied depending on the desired dressing of grinding stones 17. As discussed earlier, because of the arrangement of backing plates 74 and springs 84 and 92, the load applied by screw 52 and support arms 48 and 50 is transmitted only through bearings 80 at the ends of frame plate 62. Little or minimal vertical force is transmitted at inner edges 94 of abrasive blocks 54.

Once dresser 44 is properly situated, motors 20 and 24 rotate respective upper and lower platens 12 and 14. Unlike a conventional ring dresser, dresser 44 does not rotate with respect to upper and lower platens 12 and 14. Instead, dresser 44 remains stationary as grinding stones 17 of upper and lower platens 12 and 14 pass over abrasive blocks 54. As discussed earlier, springs 84 and bearings 82 enable abrasive blocks 54 to roll slightly as grinding stones 17 pass across. This allows each abrasive block 54 to conform to the surface of the particular grinding stone without catching on an edge thereof.

During the dressing process, upper and lower platens 12 and 14, respectively, can rotate in the same direction or counter to one another. Platens 12 and 14 rotate until dresser 44 has removed a desired amount of material from grinding stones 17. Typically, dresser 44 will remove between 80 $\mu$m and 100 $\mu$m from grinding stones 17. Factors affecting the removal rate include the pressure applied to grinding stones 17 and the speed at which platens 12 and 14 rotate.

Platens 12 and 14 can rotate at the same speed or at different speeds. For example, upper platen 12 may rotate in an opposite direction from lower platen 14 and at one third the speed of lower platen 14. Where upper platen 12 rotates at a slower speed than lower platen 14, additional weight (not shown) can be applied to upper platen 12 to compensate for the slower rotational speed.

Figure 11:
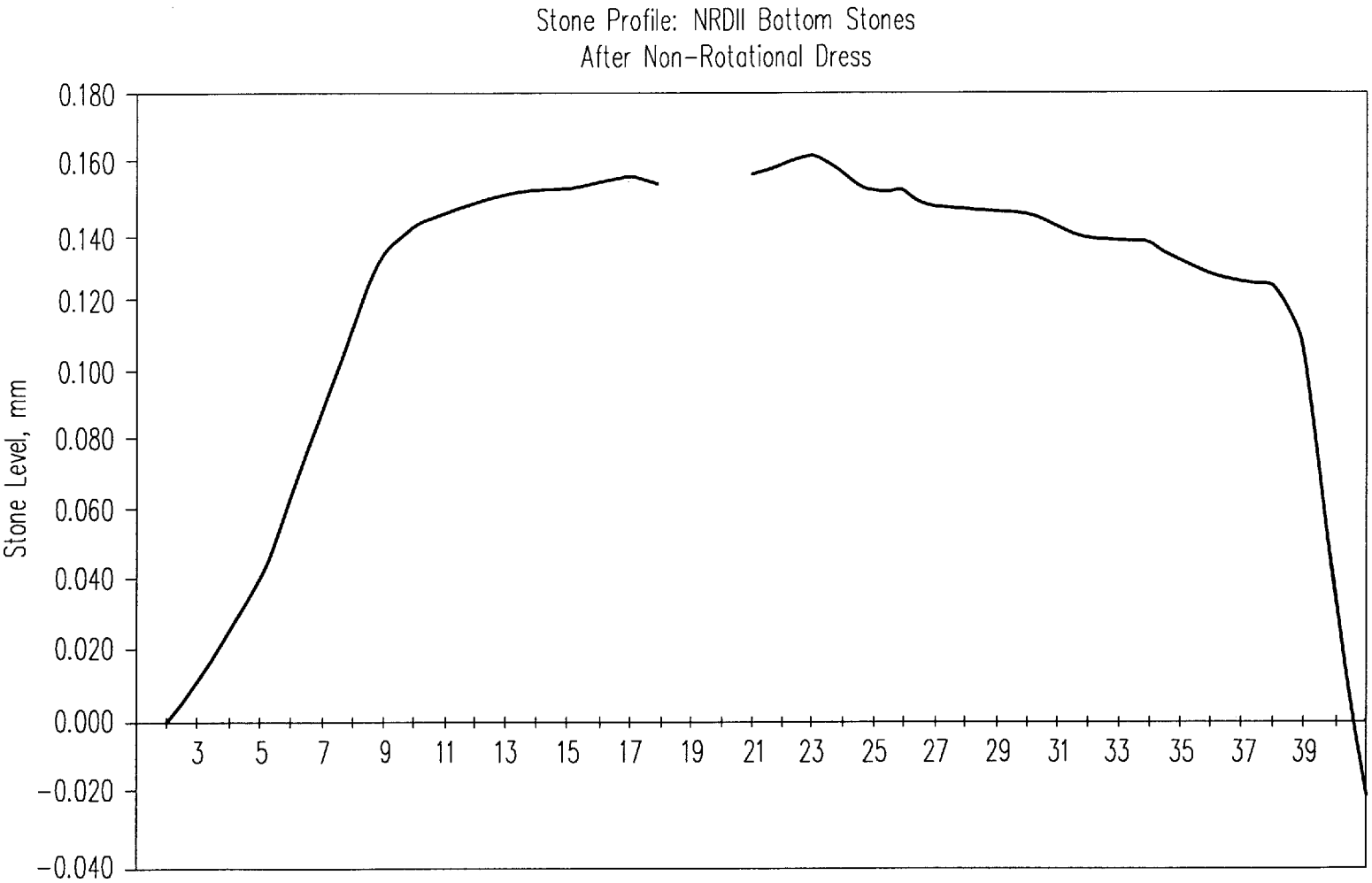
FIG. 11 is a chart illustrating the profile of a grinding stone immediately following the non-rotational dressing process of the present invention.

As platens 12 and 14 rotate, the vertical load from screw 52 and support arms 48 and 50 is transmitted only to the ends of frame plates 62, thereby preferentially loading the outer edges of abrasive blocks 54. Accordingly, as illustrated in FIG. 11, dresser 44 removes more material along the innermost and outermost edges of grinding stones 17, leaving grinding stones 17 with a slightly beveled surface. Thus, properly dressed grinding stones 17 provide for preferential machining of rigid substrates at the center of stones 17; less aggressive machining occurs along the inner and outer edges. Dresser 44 thereby reduces the OD curvature problem associated with conventional ring dressers. Grinding stones 17, dressed by dresser 44, are less aggressive at their inner and outer edges and will therefore remove less material along the OD of the rigid substrates. One skilled in the art will appreciate that dresser 44 need not dress grinding stones 17 to a beveled configuration. Dresser 44 can be modified such that abrasive blocks 54 provide grinding stones 17 with a planar grinding surface, a convex surface or any other desired configuration which reduces the OD curvature problem.

Once grinding stones 17 have been dressed with dresser 44, dresser 44 is removed from mounting plate 46. Substrate carriers 34 are then reinstalled on lower platen 14, and grinding apparatus 10 is ready to accept and grind additional rigid substrates.

The above-described non-rotational dressing process can be used either in lieu of or in conjunction with a conventional dressing process. If the non-rotational dresser is used in conjunction with convention ring dressers, the ring dressers are first used to globally shape the grinding stones. The ring dressers are then removed. The non-rotational dresser is installed, and the non-rotational dressing process dresses the grinding stones to achieve the desired stone profile.

Figure 12:
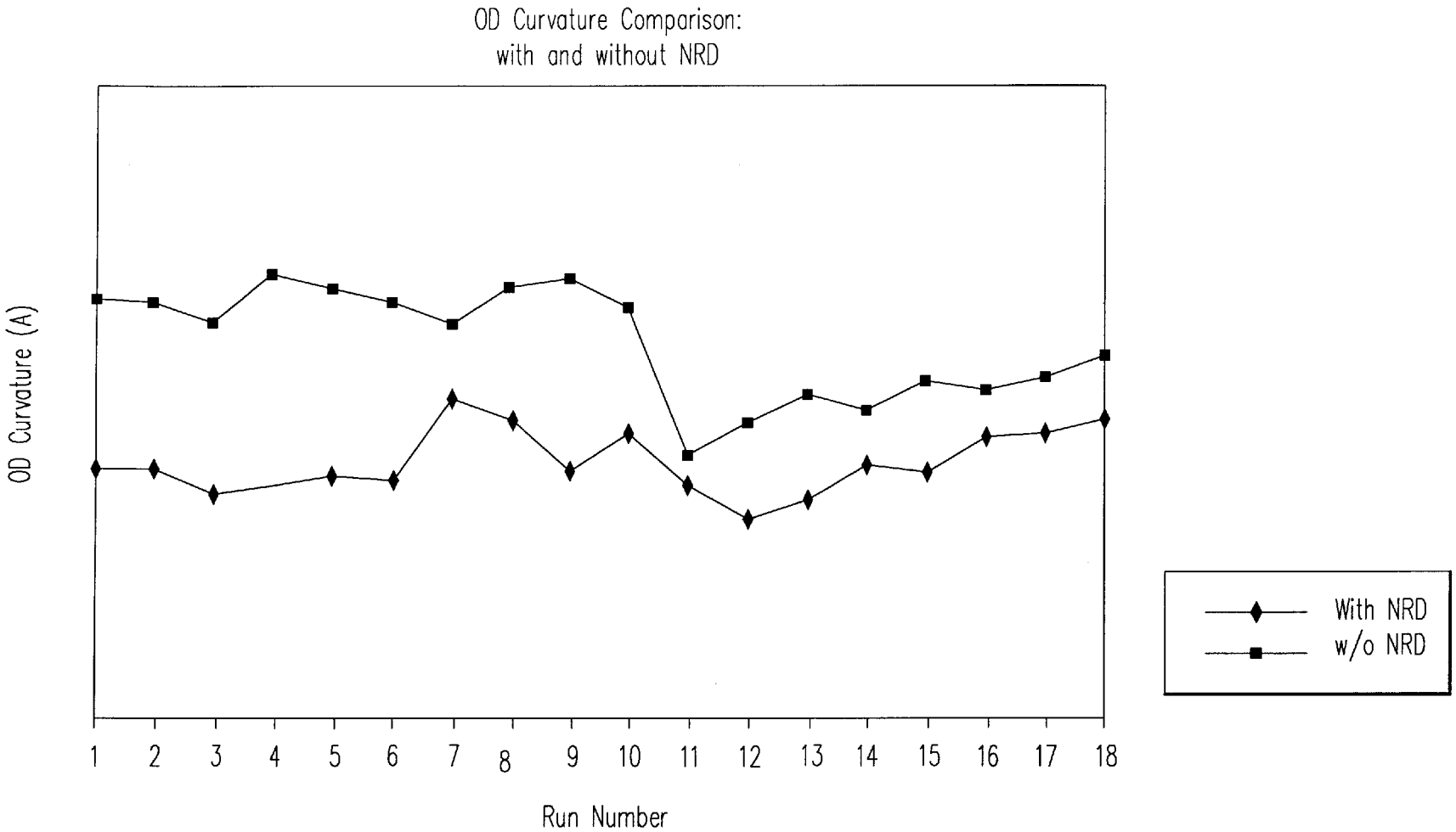
FIG. 12 is a chart comparing the OD curvature of substrates produced on the grinding apparatus of FIG. 2 using grinding stones that have been dressed using conventional ring dressers and those that have been dressed using the non-rotational dresser of the present invention.

FIG. 12 provides a comparison of the OD curvature of rigid substrates ground by grinding stones dressed using conventional ring dressers and those dressed using non-rotational dresser 44. Grinding stones that have been dressed with conventional ring dressers produce substrates with a higher OD curvature than the grinding stones dressed with dresser 44.

The non-rotational dresser of present invention is advantageous because it increases throughput of grinding apparatus 10. Dresser 44 produces grinding stones 17 which do not have highly aggressive outer edges. As a result, grinding apparatus 10 can operate under normal grinding pressures, as opposed to lower grinding pressures which hamper throughput. In addition, dresser 44 is cost effective, as it can be easily adapted to fit any conventional grinding apparatus.

While the present invention has been described with reference to specific embodiments, the description is illustrative of the invention and is not to be construed as limiting the invention. Various modifications may occur to those skilled in the art without departing from the true spirit and scope of the invention as defined by the appended claims.

What is claimed is:

1. A dresser for a grinder including at least one platen rotatable about a vertical axis and at least one grinding stone mounted to the at least one platen, the dresser comprising:

a frame mounted proximate the at least one rotatable platen; and at least one abrasive block coupled to the frame for contacting the at least one grinding stone, the at least one abrasive block extending across a portion of the at least one grinding stone, wherein the at least one abrasive block does not rotate when the at least one grinding stone rotates in contact with the at least one abrasive block, the at least one abrasive block thereby dressing the at least one grinding stone.

2. The dresser of claim 1, wherein the at least one abrasive block is pivotally coupled to the frame.

3. The dresser of claim 1, further comprising a mounting plate for mounting the frame, the mounting plate being located proximate the at least one platen.

4. The dresser of claim 1, wherein the grinder includes a sun gear and a ring gear, the at least one grinding stone extending between the sun and ring gears of the grinder.

5. The dresser of claim 4, wherein the at least one platen includes an upper platen and a lower platen, the at least one grinding stone includes at least one upper grinding stone and at least one lower grinding stone mounted to the respective upper and lower platens, and the at least one abrasive block includes at least one upper abrasive block for contacting the at least one upper grinding stone and at least one lower abrasive block for contacting the at least one lower grinding stone.

6. The dresser of claim 5, wherein the at least one upper and lower abrasive blocks are pivotally coupled to the frame.

7. The dresser of claim 5, wherein the frame comprises an upper support arm and a lower support arm pivotally coupled together, each support arm having a proximal end and a distal end, the at least one upper and lower abrasive blocks being coupled to the proximal end of the respective upper and lower support arms.

8. The dresser of claim 7, wherein the frame further comprises an upper frame plate and a lower frame plate pivotally coupled to the proximal end of the respective upper and lower support arms, the at least one upper and lower abrasive blocks being coupled to the respective upper and lower frame plates.

9. The dresser of claim 8, wherein the at least one upper and lower abrasive blocks are pivotally coupled to the respective upper and lower frame plates.

10. The dresser of claim 9, wherein two upper abrasive blocks are coupled to the upper frame plate and two lower abrasive blocks are coupled to the lower frame plate, each abrasive block being pivotally coupled at a respective end of the respective frame plate, such that each abrasive block is rotatable about the respective end of the respective frame plate.

11. The dresser of claim 9, further comprising a spring associated with each abrasive block, the spring being disposed between the respective frame plate and abrasive block and offset from a central longitudinal axis of the abrasive block, the spring biasing a side of the associated abrasive block to rotate the abrasive block about its central longitudinal axis.

12. A grinding apparatus comprising:

at least one platen rotatable about a vertical axis and including at least one grinding stone;

a dresser frame removably mounted proximate the at least one rotatable platen; and at least one abrasive block coupled to the frame for contacting the at least one grinding stone, the at least one abrasive block extending across a portion of the at least one grinding stone, wherein the at least one abrasive block does not rotate when the at least one grinding stone rotates in contact with the at least one abrasive block, the at least one abrasive block thereby dressing the at least one grinding stone.

13. The grinding apparatus of claim 12, wherein the at least one platen includes an upper platen and a lower platen, the upper platen including at least one upper grinding stone, the lower platen including at least one lower grinding stone, and wherein the at least one abrasive block includes at least one upper abrasive block and at least one lower abrasive block.

14. The apparatus of claim 13, wherein the at least one upper and lower abrasive blocks are pivotally coupled to the frame.

15. The apparatus of claim 13, wherein the frame comprises an upper support arm and a lower support arm pivotally coupled together, each support arm having a proximal end and a distal end, the at least one upper and lower abrasive blocks being coupled to the proximal end of the respective upper and lower support arms.

16. The apparatus of claim 15, wherein the frame further comprises an upper frame plate and a lower frame plate pivotally coupled to the proximate end of the respective upper and lower support arms, the at least one upper and lower abrasive blocks being pivotally coupled to the respective upper and lower frame plates.

17. The apparatus of claim 16, wherein two upper abrasive blocks are coupled to the upper frame plate and two lower abrasive blocks are coupled to the lower frame plate, each abrasive block being pivotally coupled at a respective end of the respective frame plate, such that each abrasive blocks is rotatable about the respective end of the respective frame plate.

18. The apparatus of claim 16, further comprising a spring associated with each abrasive block, the spring being disposed between the respective frame plate and abrasive block and offset from a central longitudinal axis of the abrasive block, the spring biasing a side of the associated abrasive block to rotate the abrasive block about its central longitudinal axis.

19. A method of dressing grinding stones on a grinder, the grinder including at least one platen rotatable about a vertical axis and at least one grinding stone mounted to the at least one platen, the method comprising:

mounting a dresser proximate the at least one platen, the dresser including at least one dressing surface contacting the at least one platen, the at least one dressing surface extending across the at least one grinding stone; and rotating the at least one platen while the dresser remains stationary to dress the at least one grinding stone.

20. The method of claim 19, wherein the grinder includes a plurality of substrate carriers, and further comprising removing the plurality of substrate carriers prior to mounting the dresser.

21. The method of claim 19, wherein the at least one platen includes an upper platen and a lower platen, the at least one grinding stone includes at least one upper grinding stone and at least one lower grinding stone, the at least one dressing surface of the dresser includes an upper dressing surface and a lower dressing surface for contacting the at least one upper and lower grinding stones, respectively, and further comprising lowering the upper platen onto the upper dressing surface of the dresser.

22. The method of claim 19, wherein the dresser includes an upper support arm and a lower support arm pivotally connected together, each support arm having a proximal end and a distal end, the upper and lower dressing surfaces located at the proximal end of the respective upper and lower support arms, and further comprising raising the proximal end of the upper support arm so that the upper dressing surface contacts the at least one upper grinding stone.

23. The method of claim 19, further comprising applying a larger load along inner and outer edges of the upper and lower dressing surfaces than along a central portion thereof.

24. A dresser for a grinder including at least one platen rotatable about a vertical axis and at least one grinding stone mounted to the at least one platen, the dresser comprising:

a frame mounted proximate the at least one rotatable platen; and at least one abrasive block pivotally coupled to the frame for contacting the at least one grinding stone, the at least one abrasive block extending across the at least one grinding stone, wherein the frame remains stationary when the at least one grinding stone contacts the at least one abrasive block and rotates, the at least one abrasive block thereby dressing the at least one grinding stone.

25. A dresser for a grinder including a sun gear, a ring gear, at least one platen rotatable about a vertical axis and at least one grinding stone mounted to the at least one platen, the at least one grinding stone extending between the sun and ring gears, the dresser comprising:

a frame mounted proximate the at least one rotatable platen; and at least one abrasive block coupled to the frame for contacting the at least one grinding stone, the at least one abrasive block extending across the at least one grinding stone, wherein the frame remains stationary when the at least one grinding stone contacts the at least one abrasive block and rotates, the at least one abrasive block thereby dressing the at least one grinding stone.

* * * * *